US009341415B2

(12) United States Patent
Andersson et al.

(10) Patent No.: US 9,341,415 B2
(45) Date of Patent: May 17, 2016

(54) REINFORCED HEAT EXCHANGER

(75) Inventors: Sven Andersson, Hässleholm (SE); Svante Hoberg, Åstorp (SE); Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 610 days.

(21) Appl. No.: 13/139,957

(22) PCT Filed: Dec. 11, 2009

(86) PCT No.: PCT/EP2009/066931

§ 371 (c)(1), (2), (4) Date: Aug. 19, 2011

(87) PCT Pub. No.: WO2010/069874

PCT Pub. Date: Jun. 24, 2010

(65) Prior Publication Data

US 2011/0290461 A1 Dec. 1, 2011

(30) Foreign Application Priority Data

Dec. 17, 2008 (SE) ..... 0802595

(51) Int. Cl.

| | |
|---|---|
| ***F28F 3/08*** | (2006.01) |
| ***F28D 9/00*** | (2006.01) |
| ***F28F 3/04*** | (2006.01) |

(52) U.S. Cl.

CPC ..... *F28D 9/005* (2013.01); *F28F 3/046* (2013.01); *F28F 2225/00* (2013.01)

(58) Field of Classification Search

CPC ..... F28F 3/083; F28F 9/162; F28F 9/0226; F28D 9/005; F28D 9/0037

USPC ..... 165/79, 166, 167

See application file for complete search history.

(56) References Cited

U.S. PATENT DOCUMENTS 5,291,945 A * 3/1994 Blomgren et al. ..... 165/167
5,462,113 A 10/1995 Wand (Continued)

FOREIGN PATENT DOCUMENTS

DE 199 00 629 7/1999
JP 53-61802 5/1978

(Continued)

OTHER PUBLICATIONS

International Search Report from International Application No. PCT/EP2009/066931 mailed Mar. 29, 2010 (Form PCT/ISA/210).

(Continued)

*Primary Examiner* — Marc Norman
*Assistant Examiner* — Jon T Schermerhorn
(74) *Attorney, Agent, or Firm* — Merchant & Gould P.C.

(57) ABSTRACT

A brazed heat exchanger comprises a number of heat exchanger plates (100, 200, 300) provided with a pressed pattern of ridges (110*a*) and grooves (110*b*) arranged such that flow channels for media to exchange heat are formed between neighboring plates (100,200,300). The plates (100, 200,300) are further provided with port openings (120*a-d*) in selective communication with said flow channels and with a circumferential edge formed by skirts (130;240; 335) of neighboring plates (100,200,300) overlapping one another. A reinforcement portion (140; 250;340) extends outside the skirt (130;240; 335), and comprises a ribbon of sheet metal.

5 Claims, 4 Drawing Sheets

(56) References Cited

U.S. PATENT DOCUMENTS

| | | | | |
|---|---|---|---|---|
| 5,971,065 | A | 10/1999 | Bertilson et al. | |
| 6,073,687 | A * | 6/2000 | Jensen et al. | 165/167 |
| 6,161,615 | A | 12/2000 | Brieden et al. | |
| 7,246,436 | B2 | 7/2007 | Blomgren et al. | |
| 2001/0030043 | A1 * | 10/2001 | Gleisle et al. | 165/167 |

FOREIGN PATENT DOCUMENTS

| | | | |
|---|---|---|---|
| JP | 54-163359 | | 11/1979 |
| JP | S54-163359 | U | 11/1979 |
| JP | 6-109381 | | 4/1994 |
| JP | 2002-62078 | | 2/2002 |
| JP | 2002-62079 | | 2/2002 |
| JP | 2005-514576 | | 5/2005 |
| JP | 2005-514576 | A | 5/2005 |
| JP | 2007-518958 | | 7/2007 |
| JP | 2007-232337 | | 9/2007 |
| JP | 2002-062079 | A | 2/2008 |
| WO | WO 99/36740 | | 7/1999 |
| WO | WO 2008/023732 | | 2/2008 |

OTHER PUBLICATIONS

International Search Report from International Application No. PCT/EP2009/066931 (Form PCT/ISA/237).

Japanese Notice of Reasons for Rejection with English translation from corresponding application No. 2011-541356 dated Oct. 22, 2013 (4 pages).

Office Action issued in corresponding Korean Application No. 10-20117016576, mailed Jan. 6, 2016, with English Translation.

* cited by examiner

REINFORCED HEAT EXCHANGER

This application is a National Stage Application of PCT/EP2009/066931, filed 11 Dec. 2009, which claims benefit of Serial No. 0802595-9, filed 17 Dec. 2008 in Sweden and which applications are incorporated herein by reference. To the extent appropriate, a claim of priority is made to each of the above disclosed applications.

FIELD OF THE INVENTION

The present invention relates to a brazed heat exchanger comprising a number heat exchanger plates provided with a pressed pattern of ridges and grooves arranged such that flow channels for media to exchange heat are formed between neighboring plates, the plates further being provided with port openings in communication with said flow channels and with a circumferential edge formed by a skirt which overlaps skirts of neighboring plates.

PRIOR ART

Brazed heat exchangers are used in a large number of heat exchanging applications. Compared to other types of heat exchangers, brazed heat exchanger are cost-efficient and compact.

Brazed heat exchangers comprise a number of plates provided with a pattern of pressed ridges and grooves arranged such that flow channels for media to exchange heat are formed between neighboring plates as they are stacked onto one another. Port openings are arranged to provide a selective liquid communication with the flow channels.

Usually, the plates are provided with a skirt extending around the periphery of the plate in an angle slightly offset from the perpendicular direction. The skirts of two neighboring plates will overlap one another and form a brazed edge extending around the plates, which edge seals the flow channels formed by the plates.

After the plates have been stacked onto one another, with brazing material provided on the surfaces of the plates, the entire heat exchanger is placed in a furnace to be completely brazed together. The pressed patterns of neighboring plates will provide contact points which are brazed together, In order for brazed heat exchangers to withstand high pressure, it has hitherto been necessary to enclose the heat exchanger with rigid plates in order for it not to flex or move upwards or downwards. Such rigid plates primarily strengthens the area around the port openings, which is especially susceptible to damage due to high pressure, since the pressure acting on the port hole generates a force that must be transferred from a bottom portion of the port opening to a top portion of the port opening. Without the rigid plates, the entire force must be transferred by brazing points formed between the ridges and grooves of the pressed patterns of the plates. For obvious reasons, the density of such points is low in the area of the port openings.

Heat exchangers provided with the rigid plates are, however, prone to burst around the edges, i.e. the seal provided by the overlapping skirts. The present invention aims to increase the strength of the edges of brazed heat exchangers.

Also, a well known problem with the manufacturing technique is that the stack of heat exchanger "shrinks" during the brazing operation. The shrinking is a result of the brazing material melting during the brazing, hence leaving a space enabling the stacked heat exchanger plates to come closer to one another. The shrinking is most severe in the vicinity of the port openings.

SUMMARY OF THE INVENTION

According to the invention, these and other problems are solved or alleviated by a reinforcement portion extending outside at least a part of the skirt, said reinforcement comprising a ribbon of sheet metal.

In one embodiment of the invention, the reinforcement portion is provided with a pressed pattern comprising upper and lower surfaces. The upper and lower surfaces may be arranged such that an upper surface of the reinforcement portion of a first heat exchanger plate contacts the lower surface of the reinforcement portion of a heat exchanger plate stacked on top of the first heat exchanger.

In another embodiment of the invention, the upper and lower surfaces may be arranged such that the upper and lower surfaces of neighbouring plates are aligned.

The reinforcement portion may extend in the plane of the heat exchanger plate.

In order to get an as strong heat exchanger as possible, the reinforcement portion may extend along the entire periphery of the heat exchanger plates.

The reinforcement portion may be pressed such that at least a portion of the reinforcement extends in a direction such that the ribbon and the skirt form a V.

BRIEF DESCRIPTION OF THE DRAWINGS

In the following, the invention will be described with reference to the appended drawings, wherein.

DESCRIPTION OF EMBODIMENTS

Figure 1:
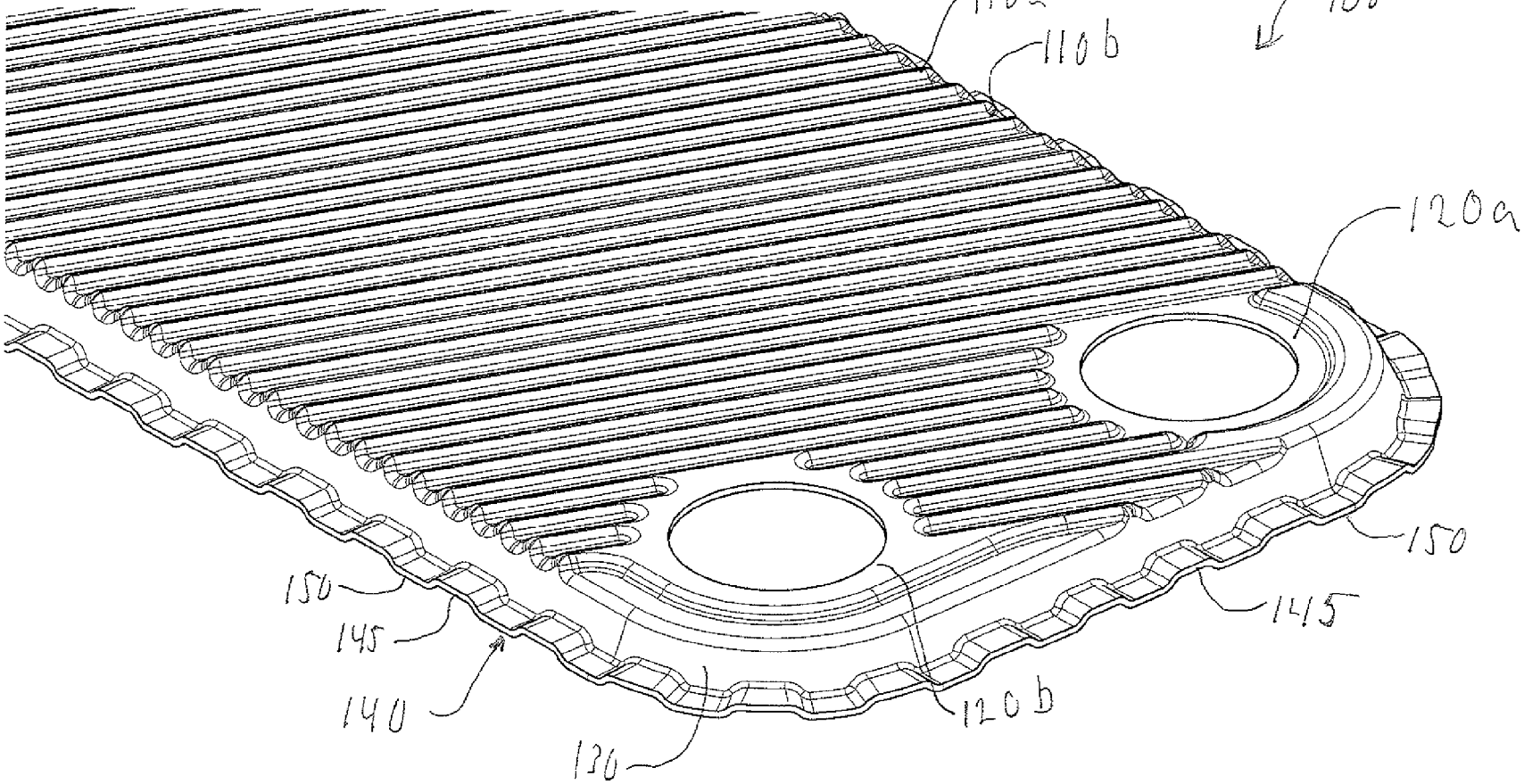
FIG. 1 is a schematic perspective view of a heat exchanger plate provided with an edge reinforcement according to a first embodiment of the present invention.

In FIG. 1, a heat exchanger plate 100 according to a first embodiment of the present invention is shown. The plate 100 extends in a general plane, and is provided with a pressed pattern of ridges 110*a* and groove 110*b*. Moreover, the plate 100 is provided with port openings 120*a-d* (only the port openings 120*a* and 120*b* are shown); neighboring openings are provided on different heights; in the shown figure, the port opening 120*b* is provided on a height equal to the height of the ridges 110*a*, whereas the port opening 120*a* is provided at the height of the grooves 110*b*.

A skirt 130 is provided in a basically perpendicular direction vis-á-vis the plane P. The skirt 130 surrounds the area provided with the ridges 110*a* and the grooves 120*b* and the port openings 120*a-d*; skirts of neighboring plates are adapted to overlap one another such that a seal between the plates is achieved. At the end of the skirt opposite the pressed pattern and the port openings, a reinforcement portion 140 is provided. The reinforcement portion extends in an outward direction parallel to the general plane P.

The reinforcement portion 140 of the first embodiment is provided with a pressed pattern comprising upper areas 145 and lower areas 150. In a first aspect of the present invention, the upper areas 145 of a first plate 100 are arranged to contact lower areas 150 of a neighboring upper plate 100, whereas the lower areas 150 of the reinforcement portion 140 of the first plate are arranged to contact the upper areas 145 of the reinforcement portion 140 of a neighboring lower plate.

For manufacturing a plate heat exchanger according to the first embodiment, heat exchanger plates 100 are stacked onto one another to form a stack of heat exchanger plates. A brazing material is provided between the plates. The brazing material may be any suitable brazing material, e.g. copper, tin, lead, silver, or stainless steel mixed with a liquid depressant, e.g. silica, boron, or mixtures thereof. The stainless steel brazing material is especially suitable if heat exchanger plates of stainless steel are used.

In some cases, it is possible to use identical heat exchanger plates for the entire stack of heat exchanger plates. In such a case, every other heat exchanger plate is rotated 180 degrees compared to its neighboring plates. This rotation results in the port areas 120*a, b* of neighboring plates interacting such that, seen from one port opening, every other flow channel will be open to a port, every other being closed. This manufacturing method is well known by persons skilled in the art of brazed heat exchangers.

Figure 4:
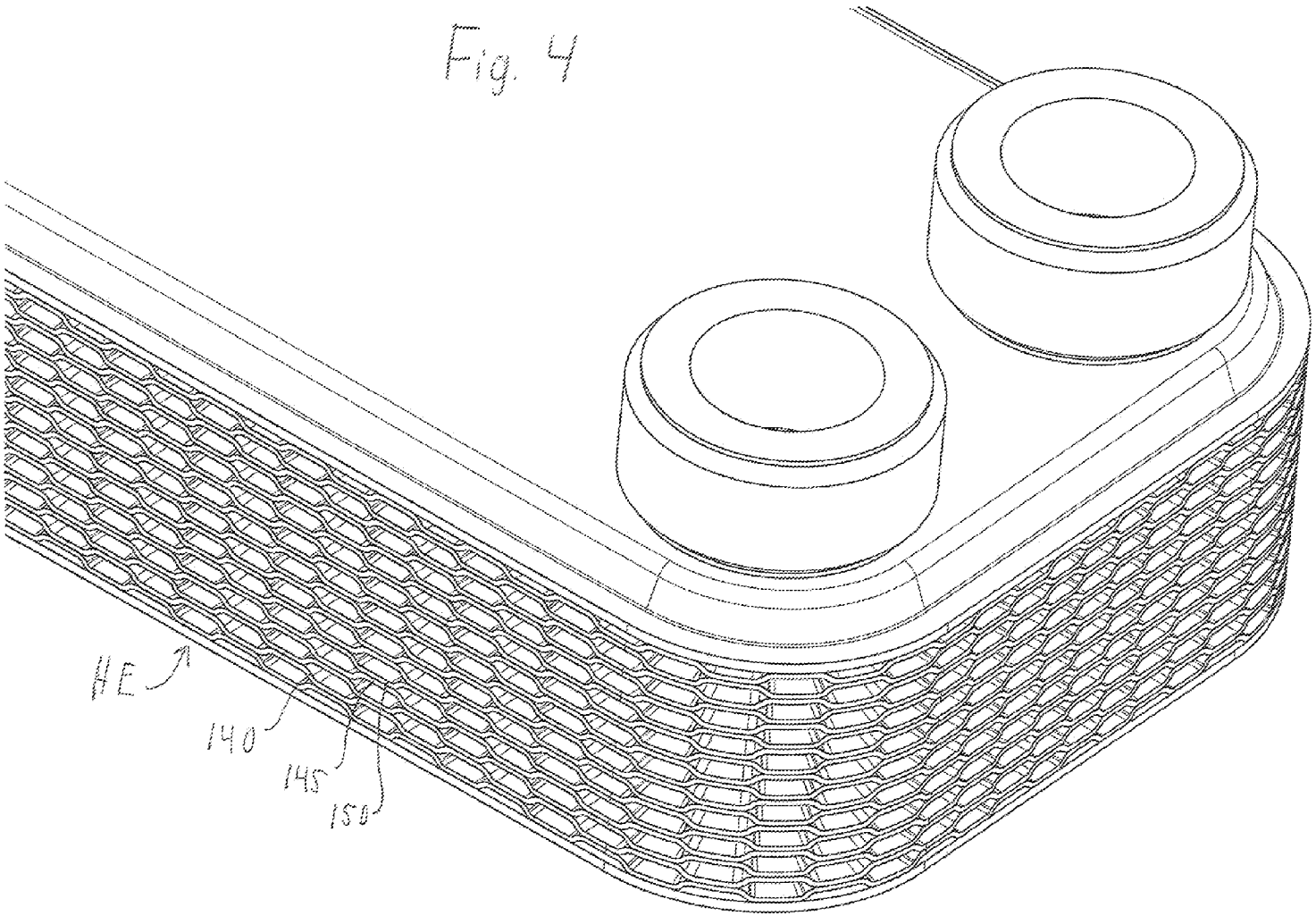
FIG. 4 is a schematic perspective view showing a heat exchanger manufactured from heat exchanger plates according to FIG. 1.

According to the first aspect, the upper areas 145 of the reinforcement portion 140 of a first plate are arranged to contact the lower areas 150 of the reinforcement portion 140 of a neighboring upper plate. This gives, except from the reinforcing effect, also the beneficial effect that shrinking of the heat exchanger plate stack during brazing is significantly reduced, especially in the vicinity of the port openings 120*a-d*. A heat exchanger made from heat exchanger plates 100 according to the first aspect is shown in FIG. 4.

According to a second aspect, the upper areas 145 of the reinforcement portion 140 of a first plate are arranged to align with the upper areas 145 of its neighboring plates; the reinforcement portions 140 of neighboring plates will then contact one another along the areas between the upper areas 145 and the lower areas 150. The second aspect is beneficial in that the connection between the neighboring reinforcement patterns become stronger connected to one another, but the positive effect on the shrinking is smaller as compared to the first aspect. The second aspect will be more thoroughly described below with reference to FIG. 3

Figure 2:
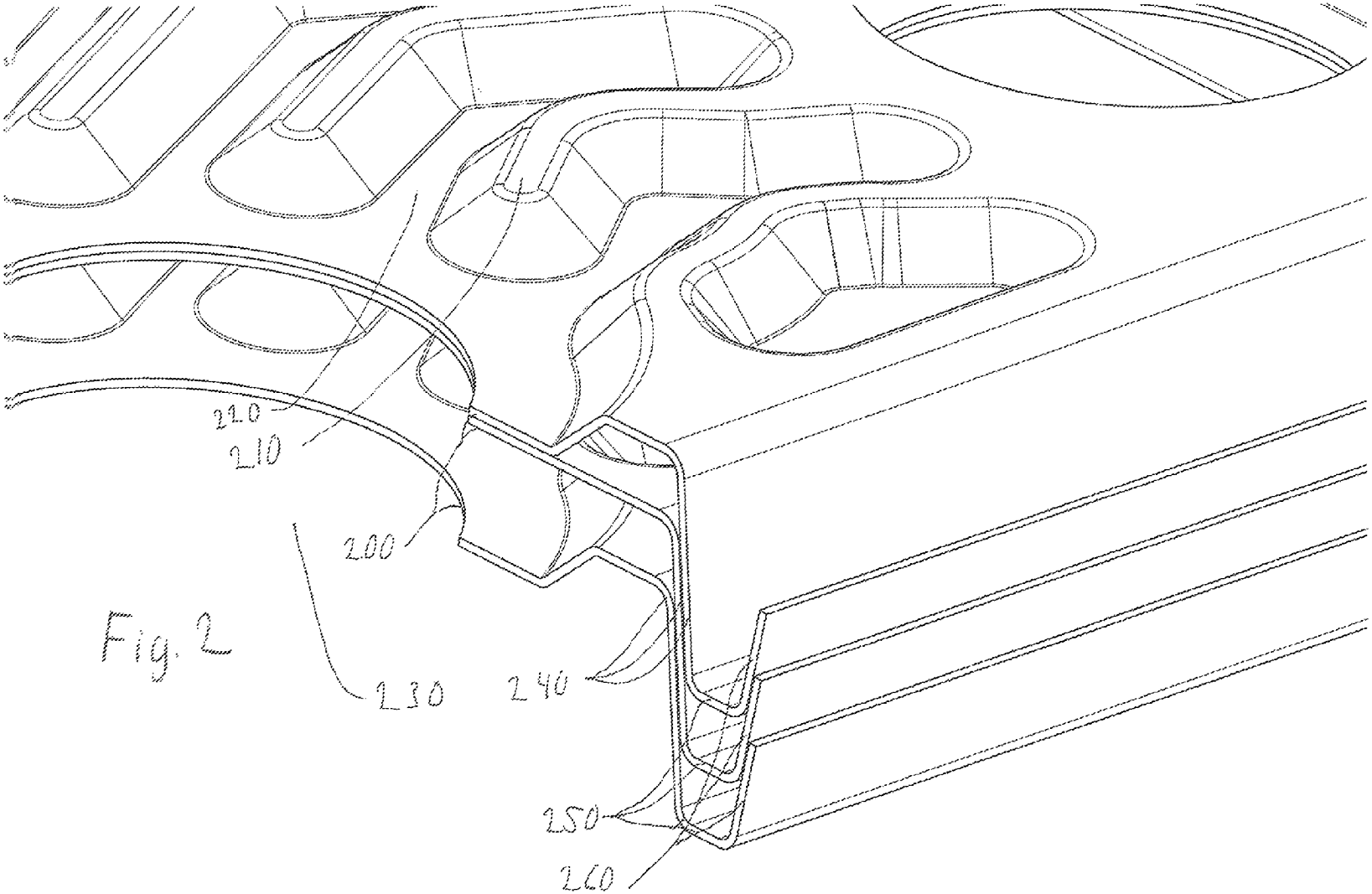
FIG. 2 is a schematic, partly sectioned, perspective view of a heat exchanger plate provided with an edge reinforcement according to a second embodiment of the present invention.

A second embodiment of the invention, shown in FIG. 2, comprises a number of heat exchanger plates 200 provided with a pressed pattern of ridges 210 and grooves 220 arranged to hold the heat exchanger plates on a distance from one another under formation of flow channels for media to exchange heat. The heat exchanger plates are moreover provided with port openings 230 (only one partially shown in FIG. 2). In order to seal off the flow channels, skirts 240 are arranged along edges of the heat exchanger plates, such skirts 240 being arranged such that an upper side of a skirt of a first heat exchanger plate will contact a lower side of a skirt of a second heat exchanger plate stacked upon the first plate.

On an outside of the skirt 240, a reinforcement ribbon 250 is provided. The reinforcement ribbon is pressed such that an outer surface 260 extends such that it forms a truncated V with respect to the skirt 240.

Preferably, the outer surface 260 of one heat exchanger cooperates with the outer surfaces 260 of neighboring plates the same way as the skirts of neighboring plates do.

Hence, neither the skirt 240 nor the outer surface 260 may be provided perpendicular to a plane P of the heat exchanger plate 200; if this would be the case, it would be impossible to stack heat exchanger plates upon one another. Instead, there must be a certain angle between the skirts and the plane P and the outer surface and the plane P.

Consequently, the outer surfaces 260 of neighboring plates will contact one another in the same way as the skirts of neighboring plates contact one another. This will, except for the increased strength of the edge, provide an extra insurance against leakage; if the connection between the skirts 240 of neighboring plates will leak, there is still a possibility that the outer surfaces 260 will provide a seal.

Figure 3:
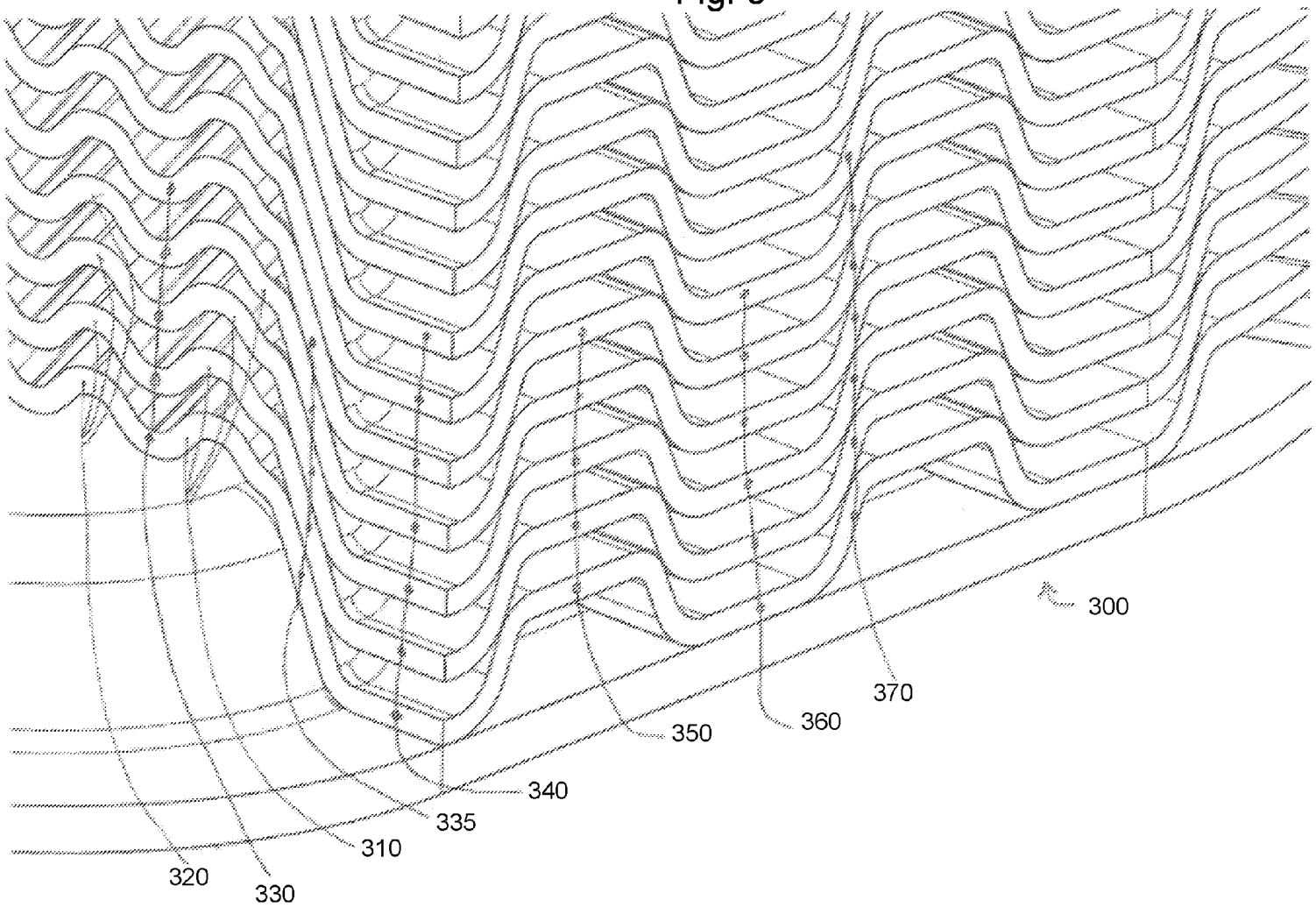
FIG. 3 is a schematic, partly sectioned, view showing a third embodiment of the present invention.

In FIG. 3, a heat exchanger 300 according to a third embodiment, equaling the second aspect as described above, of the present invention is shown. The heat exchanger comprises a number of heat exchanger plates 310, all of which being provided with ridges 320 and grooves 330 to form flow channels for media to exchange heat, port openings (not shown) and a skirt 335 surrounding the heat exchanger plate and providing a seal for the flow channels by contact between skirts 335 of neighboring plates 300.

Moreover, the heat exchanger plates 300 according to the third embodiment comprises a reinforcing portion 340, which resembles the reinforcement area 140 of the heat exchanger plates according to the first embodiment in that it comprises pressed ridges 350 and grooves 360. However, the ridges and groves of the third embodiment differ from the ridges and grooves of the first embodiment in that the ridges 350 and grooves 360 of one heat exchanger plate of the third embodiment are located to be placed inline with the ridges 350 and grooves 360 of neighboring plates. Consequently, the ridges and grooves of heat exchanger plates of the third embodiment will not touch one another.

Instead, contact between the reinforcing portions 340 of neighboring heat exchanger plates takes place between walls 370 connecting said ridges and grooves.

In FIG. 4, a heat exchanger HE comprising heat exchanger plates according to the first embodiment is shown. Here, the interaction between the upper areas 145 and the lower areas 150 of the reinforcement portions 140 of neighboring plates is clearly shown.

In still another embodiment of the invention, the reinforcement portion only extends around the port areas, i.e. not along the long sides of the heat exchanger plates. This embodiment strengthens the ports, and may be reducing shrinking of the heat exchanger plate stack, but provides only a minor increase of the strength of the sides; as mentioned above, the area around the ports is particularly prone to break.

Persons skilled in the art will realize that there are several modifications possible within the scope of the invention without departing from the same; such as it is defined by the appended claims.

The invention claimed is:

1. Brazed heat exchanger comprising a number of heat exchanger plates provided with a pressed pattern of ridges and grooves arranged such that flow channels for media to exchange heat are formed between neighboring plates, the plates further comprising port openings in selective communication with said flow channels, a circumferential edge formed by skirts of the neighboring plates overlapping one another, and a reinforcement portion extending outside the skirt, said reinforcement portion comprising a ribbon of sheet metal, wherein the reinforcement portion is provided with a pressed pattern comprising upper and lower surfaces arranged such that the upper surface of the reinforcement portion of a first heat exchanger plate contacts the lower surface of the reinforcement portion of a second heat exchanger plate stacked on top of the first heat exchanger plate, and wherein a brazing material is provided between the circumferential edge formed by the skirts of the neighboring plates overlapping one another and between the reinforcement portions of the neighboring plates so that the brazing material is provided between every one of the neighboring plates.

2. The brazed heat exchanger according to claim 1, wherein the upper and lower surfaces are arranged such that the upper and lower surfaces of the neighboring plates are aligned.

3. The brazed heat exchanger according to claim 1, wherein the reinforcement portion extends in a plane of the heat exchanger plate.

4. The brazed heat exchanger according to claim 1, wherein the reinforcement portion extends over an entire periphery of the heat exchanger plates.

5. The brazed heat exchanger of claim 1, wherein the ribbon of sheet metal extending outside the skirt is pressed such that at least a portion of the ribbon extends in a direction such that the ribbon and the skirt form a truncated V.

* * * * *